US009394857B2

(12) United States Patent
Yudanov

(10) Patent No.: US 9,394,857 B2
(45) Date of Patent: Jul. 19, 2016

(54) FUEL SYSTEM AND CORRESPONDING METHOD

(75) Inventor: Sergi Yudanov, Västra Frölunda (SE)

(73) Assignee: Volvo Lastvagnar AB, Göteberg (SE)

( * ) Notice: Subject to any disclaimer, the term of this patent is extended or adjusted under 35 U.S.C. 154(b) by 194 days.

(21) Appl. No.: 14/367,948

(22) PCT Filed: Jan. 3, 2012

(86) PCT No.: PCT/EP2012/000010

§ 371 (c)(1),
(2), (4) Date: Jun. 23, 2014

(87) PCT Pub. No.: WO2013/102467

PCT Pub. Date: Jul. 11, 2013

(65) Prior Publication Data

US 2015/0068496 A1 Mar. 12, 2015

(51) Int. Cl.
*F02M 31/20* (2006.01)
*F02M 63/00* (2006.01)
(Continued)

(52) U.S. Cl.
CPC ..... *F02M 31/20* (2013.01); *F02D 41/3863* (2013.01); *F02M 55/002* (2013.01); *F02M 63/005* (2013.01); *F02M 63/0005* (2013.01); *F02M 63/0029* (2013.01); *F02M 63/02* (2013.01); *F02M 63/022* (2013.01);
(Continued)

(58) Field of Classification Search
CPC ..... F02M 31/20; F02M 67/10; F02M 63/02; F02M 63/0275; F02M 63/005; F02M 63/0245; F02M 55/002; F02M 2200/95; F02M 2200/40; F02D 41/3872; F02D 41/123; F02D 41/0025
See application file for complete search history.

(56) References Cited

U.S. PATENT DOCUMENTS 7,891,342 B2 * 2/2011 Dintino ..... F02D 41/3863 123/458
2002/0092505 A1 7/2002 Rembold et al.
2008/0202471 A1 8/2008 Yudanov

FOREIGN PATENT DOCUMENTS

CN 101297108 A 10/2008
DE 102005012997 A1 9/2006
(Continued)

OTHER PUBLICATIONS

Chinese Official Action (Dec. 30, 2015) for corresponding Chinese App. 201280065970.9.
(Continued)

*Primary Examiner* — Hieu T Vo
(74) *Attorney, Agent, or Firm* — WRB-IP LLP

(57) ABSTRACT

A fuel system includes a low pressure fuel system, a high-pressure fuel pump, a common rail, at least one fuel injector, and an engine management system. The engine management system may initiate a recirculating cooling fuel flow through the high-pressure fuel pump for avoiding fuel boiling by either increasing the target pressure of the fuel within the common rail above a threshold level, which triggers opening a high-pressure fuel relief valve, such that fuel supplied by the high-pressure fuel pump is returned to the low pressure fuel system via the high-pressure fuel relief valve, or providing increased internal fuel leakage within the at least one fuel injector, such that fuel supplied by the high-pressure fuel pump is returned to the low pressure fuel system by a return line.

14 Claims, 3 Drawing Sheets

(51) Int. Cl.

| | |
|---|---|
| ***F02M 63/02*** | (2006.01) |
| ***F02M 55/00*** | (2006.01) |
| ***F02M 69/46*** | (2006.01) |
| ***F02D 41/38*** | (2006.01) |
| ***F02M 67/10*** | (2006.01) |
| *F02D 41/12* | (2006.01) |
| *F02D 41/00* | (2006.01) |

(52) U.S. Cl.

CPC ..... *F02M63/0215* (2013.01); *F02M 63/0225* (2013.01); *F02M 63/0245* (2013.01); *F02M 63/0275* (2013.01); *F02M 67/10* (2013.01); *F02M 69/465* (2013.01); *F02D 41/0025* (2013.01); *F02D 41/123* (2013.01); *F02D 41/3872* (2013.01); *F02M 2200/18* (2013.01); *F02M 2200/40* (2013.01); *F02M 2200/95* (2013.01)

(56) References Cited

FOREIGN PATENT DOCUMENTS

| | | | |
|---|---|---|---|
| DE | 102008001015 | A1 | 10/2009 |
| EP | 1180595 | A2 | 2/2002 |
| EP | 1243786 | A1 | 9/2002 |
| EP | 2011994 | A1 | 1/2009 |
| WO | 0140638 | A2 | 6/2001 |

OTHER PUBLICATIONS

International Search Report (Nov. 21, 2012) for corresponding International App. PCT/EP2012/000010.

International Preliminary Report on Patentability (Oct. 25, 2013) for corresponding International App. PCT/EP2012/000010.

* cited by examiner

FUEL SYSTEM AND CORRESPONDING METHOD

BACKGROUND AND SUMMARY

The present invention relates to a fuel system for supplying pressurised low viscosity fuel to an internal combustion engine. The fuel system comprises a low pressure fuel system, a high-pressure fuel pump, a common rail, a fuel injector, and an engine management system (EMS). The high-pressure fuel pump is arranged to supply pressurised fuel to the common rail, and the common rail is arranged to supply high-pressure fuel to the fuel injector, which is configured to inject high-pressure fuel into a combustion chamber of the combustion engine. The present invention also relates to a corresponding method for providing a recirculating cooling fuel flow through at least a high-pressure fuel pump.

Fuel systems for supplying high-pressure fuel to fuel injectors are well-known in the background art. These fuel systems normally comprise a low pressure fuel system, a high-pressure fuel pump, a common rail with fuel injectors connected thereto. A low-pressure feed pump of the low pressure fuel system feeds fuel to the high-pressure fuel pump, which is configured to supply pressurised fuel to the common rail. Fuel injectors are configured to receive high-pressure fuel from the common rail, and to inject high-pressure fuel into the combustion chamber of the combustion engine.

One potential problem with such fuel systems is fuel boiling in hot conditions, in particular upon use of low viscosity fuels, such as dimethyl ether (DME) or the like. Upon fuel boiling within the high-pressure fuel pump, the volumetric efficiency is reduced, which in turn may lead to reduced or complete loss of fuel pressure. As a result, the engine may stall.

EP1180595 discloses a fuel supply arrangement where a valve 30 is arranged downstream of a low pressure pump 6 and upstream of a high pressure pump 12. When the temperature in the arrangement is increased the valve 30 is closed. The closing of the valve 30 increases the flow and cooling through the second high pressure fuel pump 12.

DE102005012997 discloses a method for reducing pressure in the high pressure area of an injection system, wherein an actuator of an injector is controlled by a control valve and an injector in such a manner that the injector remains closed while the control valve is at least partially opened, thereby allowing fuel to run off from the high pressure area of the injection system via the control valve.

One known measure for avoiding fuel boiling within the high-pressure fuel pump is to provide the high-pressure fuel pump with a cooling orifice situated upstream of an inlet metering valve of the high-pressure fuel pump. Such a solution is known from US 2010/0282211 A1. The cooling orifice provides a flow path from a high-pressure fuel pump inlet to a low pressure pump outlet, and the flow of fuel through the high-pressure fuel pump acts to cool the pump by conducting away heat generated therein during operation. Fuel boiling within the high-pressure fuel pump can however occur during certain operating conditions and fuel pump designs, despite the provision of a cooling orifice.

There is thus a need for an improved fuel system removing the above mentioned disadvantage.

It is desirable to provide an inventive fuel system, wherein the risk for fuel boiling within the high-pressure fuel pump is reduced.

The invention concerns, according to an aspect thereof, a fuel system for supplying pressurised low viscosity fuel, in particular dimethyl ether (DME) or a blend thereof, to an internal combustion engine, in particular a compression ignition engine, said fuel system comprising a low pressure fuel system, a high-pressure fuel pump, a common rail, at least one fuel injector, and an engine management system (EMS), wherein said high-pressure fuel pump is arranged to supply pressurised fuel to said common rail, and said common rail is arranged to supply high-pressure fuel to said at least one fuel injector, which is configured to inject high-pressure fuel into a combustion chamber of said combustion engine.

The inventive fuel system is characterised in that said engine management system (EMS) may initiate a recirculating cooling fuel flow through at least the high-pressure fuel pump for avoiding fuel boiling by means of either increasing the target pressure of the fuel within the common rail above a threshold level, which triggers opening a high-pressure fuel relief valve that is arranged downstream of said high-pressure fuel pump, such that at least part of the fuel supplied by said high-pressure fuel pump is returned to said low pressure fuel system via said high-pressure fuel relief valve, or providing increased internal fuel leakage within said at least one fuel injector, such that at least part of the fuel supplied by said high-pressure fuel pump is returned to said low pressure fuel system by a return line.

The invention further concerns a method for providing a recirculating cooling fuel flow through at least a high-pressure fuel pump, wherein said fuel pump is part of a fuel system that is configured to supply pressurised low viscosity fuel, in particular dimethyl ether (DME) or a blend thereof, to an internal combustion engine, in particular a compression ignition engine, said fuel system comprising a low pressure fuel system, a high-pressure fuel pump, a common rail, at least one fuel injector, and an engine management system (EMS), wherein said high-pressure fuel pump is arranged to supply pressurised fuel to said common rail, and wherein said common rail is arranged to supply high-pressure fuel to said at least one fuel injector, which is configured to inject high-pressure fuel into a combustion chamber of said combustion engine.

The inventive method being characterised by initiating a recirculating cooling fuel flow through at least the high-pressure fuel pump for avoiding fuel boiling by means of either increasing the target pressure of the fuel within the common rail above a threshold level that triggers opening a high-pressure fuel relief valve that is arranged downstream of said high-pressure fuel pump, such that at least part of the fuel supplied by said high-pressure fuel pump is returned to said low pressure fuel system via said high-pressure fuel relief valve, or providing increased internal fuel leakage within said at least one fuel injector, such that at least part of the fuel supplied by said high-pressure fuel pump is returned to said low pressure fuel system by a return line.

The inventive fuel system and corresponding method reduces the probability of fuel boiling within the high-pressure fuel pump by guaranteeing a fuel cooling flow throughout the entire high-pressure fuel pump. The prior art solution with a cooling orifice as described above only cools a part of the high pressure fuel pump, namely the part up to the cooling orifice itself, but not the part beyond the inlet metering valve of the high pressure fuel pump. Fuel vapour bubbles developing downstream of the inlet metering valve, i.e. at the suction side of the high pressure pumping unit of the high pressure fuel pump, will thus not be evacuated by the prior art solution, thereby drastically reducing the pump volumetric efficiency.

According to a first embodiment of the invention for guaranteeing said fuel cooling flow throughout the entire high-pressure fuel pump, a cooling fuel flow from the high pressure fuel pump to the low pressure fuel system is provided via a high pressure fuel relief valve that is arranged downstream of said high-pressure fuel pump.

Cooling fuel flow is thereby guaranteed to pass all essential parts of the high pressure fuel pump, thereby suppressing the formation of and evacuating any unwanted fuel vapour bubbles not only upstream the inlet metering valve, but also downstream said inlet metering valve, i.e. at the high pressure pumping unit. Said cooling flow via said high pressure fuel relief valve is provided by temporarily increasing the target pressure of the fuel within the common rail above a threshold level, which triggers opening a high-pressure fuel relief valve.

In case an existing safety relief valve is provided downstream the high pressure fuel pump for preventing damages to the high pressure pump, common rail, or fuel injectors due to excessive fuel pressure, then said existing safety relief valve may preferably be used as high pressure fuel relief valve, such that no additional high pressure fuel relief valve is required, thereby reducing cost of the fuel system, as well as increasing reliability and durability of the fuel system.

According to a second embodiment of the invention for guaranteeing said fuel cooling flow throughout the entire high-pressure fuel pump, a cooling fuel flow from the high pressure fuel pump to the low pressure fuel system is provided by increased internal fuel leakage within said at least one fuel injector. After being leaked from the injector, the cooling fuel flow is returned to said low pressure fuel system by a return line, which connects each fuel injector with the low pressure fuel system. This solution does normally not require any additional hardware components, and is preferably implemented merely by new software. No, or at least no additional high pressure fuel relief valve is consequently required, thereby reducing cost and increasing reliability and durability of the fuel system.

According to the invention, said engine management system (EMS) is preferably arranged to, upon determining a risk of fuel boiling within said high-pressure fuel pump, initiate said recirculating cooling fuel flow through said high-pressure fuel pump. The recirculating cooling fuel flow is thus only initiated when a risk of fuel boiling is determined. When no or only a low risk of fuel boiling is estimated, no recirculating cooling fuel flow is provided. The level of risk is preferably determined by the engine management system based on one or more indicators, as discussed more in detail below. The degree of recirculating fuel flow may be fixed or variable.

According to the invention, said engine management system (EMS) is preferably configured to determine that there is a risk of fuel boiling within said high-pressure fuel pump when the engine is operated in a fuel non-injection mode. Engine operation in a fuel non-injection mode is an easy to implement indicator for an elevated risk of fuel boiling, because during fuel non-injection mode, essentially no fuel flows through the complete high pressure pump, i.e. also passing the high pressure pumping unit. The high pressure fuel pump inlet metering valve is nearly closed, and then the fuel within the high pressure fuel pump may quickly vaporise, leading to loss of volumetric efficiency. Fuel non-injection mode may for example occur during coasting or engine braking of a vehicle.

According to the invention, said engine management system (EMS) is preferably configured to determine the risk of fuel boiling within said high-pressure fuel pump based on at least one of the following parameters: engine operation mode, duration of said engine operation mode, fuel temperature adjacent and/or within said high-pressure fuel pump, fuel pressure adjacent and/or within said high-pressure fuel pump, fuel boiling point. As described above, fuel non-injection mode may be used as a more simple indicator for elevated risk of fuel boiling. However, in certain circumstances, it may be advantageous not to initiate recirculating cooling fuel flow based merely on entering a non-injection mode. For example, the duration of the engine operation mode is relevant because a short time period of engine non-injection mode does not immediately result in fuel boiling. Moreover, the fuel temperature and the fuel properties itself are relevant indicators that may be taken into account upon determining the risk.

According to the invention, said high-pressure fuel relief valve is preferably a mechanical relief valve, which preferably is arranged along the fuel supply line between said high-pressure fuel pump and said common rail, or connected to said common rail. A mechanical relief valve implies low cost, not only for the valve itself but also because no electronic control thereof is required. The positioning of the valve is somewhere downstream from the high pressure fuel pump.

According to the invention, said high-pressure fuel relief valve preferably also functions as a safety pressure limiting relief valve of said fuel system for preventing damages to any of said common rail, said at least one fuel injector, or said high-pressure fuel pump due to excessive fuel pressure. By providing the high-pressure fuel relief valve with the dual functionality of allowing recirculating cooling fuel flow, as well as operating as safety pressure limiting relief valve, only a single relief valve is required downstream the high pressure fuel pump, thereby reducing cost and increasing reliability and durability of the fuel system.

According to the invention, said high-pressure fuel relief valve is preferably a single relief valve downstream of said high-pressure fuel pump and upstream of said at least one fuel injector.

According to the invention, said fuel system could further comprise an additional safety relief valve arranged downstream of said high-pressure fuel pump and upstream of said at least one fuel injector, wherein the threshold level that triggers opening said high-pressure fuel relief valve is lower than the threshold level that triggers opening of said additional safety relief valve. This arrangement comprising two relief valves, each having a different threshold for triggering opening thereof, may be advantageous in terms of safety aspects of the fuel system due to relief valve redundancy. Moreover, the additional safety relief valve may be electronically controlled, such that the threshold for triggering opening thereof may vary depending on the operating mode, and the like.

According to the invention, said temporarily increased internal fuel leakage within said at least one fuel injector is preferably provided by increasing valve control leakage within said at least one fuel injector. This type of temporarily increased internal fuel leakage is easily implemented, preferably by suitable software only. No amendments of the high pressure fuel pump or common rail is necessary, thereby avoiding expensive redesign.

According to the invention, said valve control leakage within said at least one fuel injector is preferably increased by allowing inlet of fuel from said common rail to an internal injector volume of said at least one fuel injector, while simultaneously and/or subsequently allowing discharge of fuel from said internal injector volume to said return line, wherein said inlet and discharge of fuel is directly or indirectly controlled by said engine management system (EMS) such that no fuel is injected into said combustion chamber.

According to the invention, said at least one fuel injector preferably comprises: a spring-loaded nozzle for injecting high-pressure fuel into said combustion chamber; an inlet valve arranged on a fuel supply line connecting said nozzle with said common rail, which inlet valve is directly or indirectly controlled by said engine management system (EMS); and a fuel spill valve arranged on a fuel return line connecting said low pressure fuel system with said fuel supply line between said inlet valve and said nozzle, which fuel spill valve is directly or indirectly controlled by said engine management system (EMS); wherein said inlet of fuel is controlled by said inlet valve, and said discharge of fuel is controlled by said spill valve, and wherein during the time of temporarily increased internal fuel leakage within said at least one fuel injector said inlet valve and spill valve are controlled such that the fuel pressure within said internal injector volume is not exceeding a threshold level that triggers opening of said nozzle, thereby preventing fuel from being injected into said combustion chamber.

According to the invention, said temporarily increased internal fuel leakage within said at least one fuel injector is preferably provided by means of a series of short duration control pulses from said engine management system (EMS) for providing repeated short duration inlet of fuel into said internal injector volume and discharge of fuel from said volume. Each fuel inlet duration must be sufficiently short not to result in injection of fuel into said combustion chamber, which for example depending on fuel injector design may occur when the fuel pressures downstream the inlet valve of the fuel injector exceeds the nozzle closing force. Hence, a series of short duration control pulses results in a sufficient recirculating cooling fuel flow through the fuel injector and back to the low pressure fuel system via the return line.

According to the invention, said temporarily increased internal fuel leakage within said at least one fuel injector is preferably configured to be realised also during engine injecting operation mode by scheduling said inlet and discharge of fuel between time periods of normal inlet and discharge of fuel associated with said engine injecting operation mode. Thereby, recirculating cooling fuel flow may be provided not only in an engine non-injecting operation mode, but also during an engine injecting operation mode. This may be advantageous especially during low fuel consumption operating modes due to the relatively low cooling effect of the fuel consumption flow.

BRIEF DESCRIPTION OF THE DRAWINGS

The present invention will now be described in detail with reference to the figures, wherein.

DETAILED DESCRIPTION

Various aspects of the invention will hereinafter be described in conjunction with the appended drawings provided to illustrate and not to limit the invention, wherein like designations denote like elements, and variations of the aspects are not restricted to the specific shown aspect, but are applicable to other variations of the invention.

Figure 1:
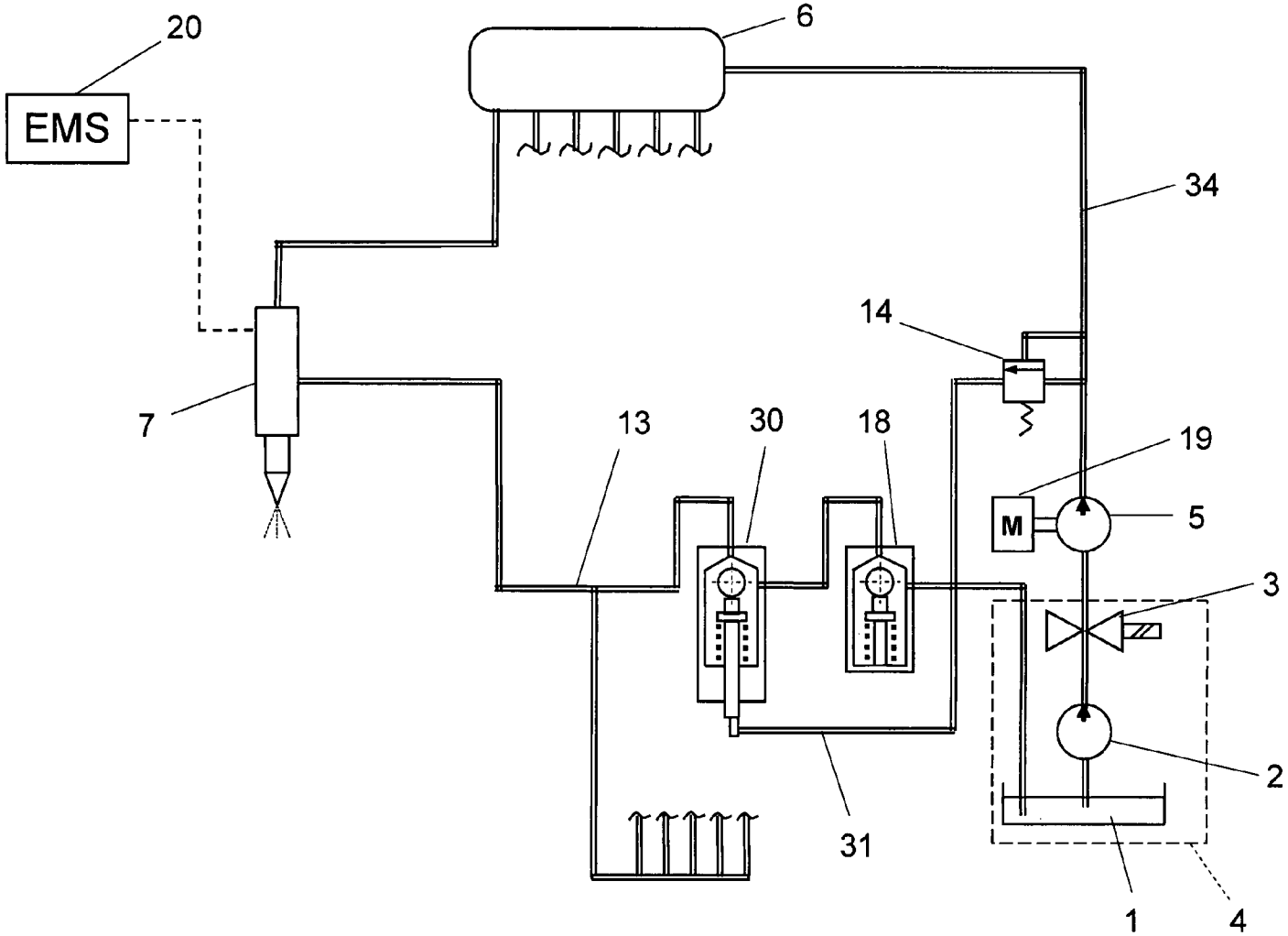
FIG. 1 shows a fuel system according to a first embodiment of the invention.

FIG. 1 shows a fuel system according to a first embodiment of the invention comprising a fuel tank 1, a feed pump 2, an isolating valve 3 and other associated components (not shown) forming a low-pressure system 4, and a high-pressure fuel pump 5 delivering fuel under pressure to a common rail 6, which supplies pressurised fuel to a plurality of fuel injectors 7 (only one shown) of a multi-cylinder engine (not shown). The fuel injector 7 may be of any conventional type, such as for example any of the types disclosed in US 2008/0202471 A1, wherein the engine management system 20 electronically controls the timing and fuel amount to be injected. The plurality of fuel injectors 7 are all connected to a common fuel injector return line 13, which is connected to the low-pressure system 4 via a pressure isolating valve 30 and a backpressure regulator 18, in that order. The pressure isolating valve 30 is arranged to prevent leakage from the low-pressure system into the combustion chamber via the fuel injectors 7, and exerts a weak closing force such that the valve is essentially open during an engine operation state, and closes first upon stopping the engine. Any fuel leaking past the valve stem of the pressure isolating valve 30 is fed to the fuel tank 1 via a separate pressure isolating valve return line 31. See documents US 2011/0005494 and U.S. Pat. No. 6,189,517B1 for more details of the function of the pressure isolating valve 30. The spring loaded backpressure regulator 18 generates a certain backpressure upstream of the backpressure regulator 18 for the purpose of avoiding vaporisation of the fuel. The backpressure regulator 18 is completely encapsulated to avoid any fuel leakage. An engine management system (EMS) 20 controls at least the fuel injector 7, but preferably also the feed pump 2 and the high pressure fuel pump 5.

The fuel injection system according to the present invention works as follows:

During combustion operating mode of the engine, i.e. during fuel injection operating mode, feed pump 2 supplies low pressure fuel to a pump inlet of the high pressure fuel pump 5, which is powered by a motor 19. From the high pressure fuel pump inlet, fuel is fed to an inlet metering valve that is operable to meter a precise volume of fuel to a high pressure pumping unit of the high pressure fuel pump 5. Depending on the type of fuel used, the pumping unit pressurises the fuel to a high pressure, normally from around 200 bar up to and above 2000 bar depending on fuel properties. For example, diesel fuel is normally pressurised to about 2000 bar, whereas DME fuel may only be pressurised to about 350 bar. The pressurised fuel is subsequently supplied to the common rail 6, which acts as a small reservoir of pressurised fuel that supplies high pressure fuel to the fuel injectors 7.

The inherent fuel consumption during the fuel injection operating mode causes a natural cooling flow of fuel through the components of the fuel system, where relatively cool fuel from the fuel tank 1 passes through the feed pump 2, high pressure fuel pump 5, common rail 6 and fuel injectors 7. However, during non-combustion operating mode of the engine, such as during coasting or engine braking, also referred to as fuel non-injection operating mode, the output shaft of the engine rotates but no power output is provided, no combustion occurs, due to the lack of fuel injection into the combustion chambers. This operation mode stops the consumption cooling flow of fuel through the fuel system, thereby leading to increased temperature of the components of the fuel system. The problem of fuel boiling then becomes more significant, in particular within the high pressure pumping unit of the high pressure fuel pump 5, because the volumetric efficiency of the high pressure fuel pump may diminish upon fuel boiling therein.

A solution to this problem according to a first embodiment of the invention is disclosed in FIG. 1, where a high pressure fuel relief valve 14 is provided downstream of the high pressure fuel pump 5. The high pressure fuel relief valve 14 is here arranged on a fuel line between the high pressure fuel pump 5 and common rail 6, but other positions are possible as long as pressurised fuel supplied by the high pressure fuel pump 5 is supplied to the high pressure fuel relief valve 14. The high pressure fuel relief valve 14 is a normally closed mechanical relief valve, i.e. a spring loaded check valve or the like, preventing the need for an expensive and complex electrically controlled valve. The threshold level of the high pressure fuel relief valve 14 that triggers opening thereof is set to a level above the normal working pressure of the common rail. For example, during use of DME as fuel, the normal working pressure of the common rail, and thus also the output pressure of the high pressure fuel pump 5, may be set to 350 bar, and the threshold level of the high pressure fuel relief valve 14 that triggers opening thereof may be set to 420 bar.

The engine management system 20 continuously monitors one or more indicators for determining the risk of fuel boiling within the fuel system. Upon determining that an elevated risk for fuel boiling within for example the high pressure fuel pump 5 exists, the engine management system 20 adjusts the target pressure of the fuel within the common rail 6 to a value at or above the trigger point of the high pressure fuel relief valve 14. As a consequence, the fuel pressure at the outlet of the high pressure fuel pump 5 is increased, and after a short time period, the opening trigger point of the high pressure fuel relief valve 14 is reached, such that said relief valve 14 opens. High pressure fuel from the high pressure fuel pump 5 is consequently allowed to return to the low pressure system 4 of the fuel system via a relief valve return line, creating a recirculating fuel cooling flow through the entire high pressure fuel pump 5. As soon as the risk of fuel boiling is reduced to a sufficiently low level, the engine management system 20 adjusts the target pressure within the common rail 6 back to a value corresponding to normal operation, upon which the high pressure relief valve 14 closes, and the artificially created recirculating fuel cooling flow through the high pressure fuel pump 5 is stopped.

Figure 2:
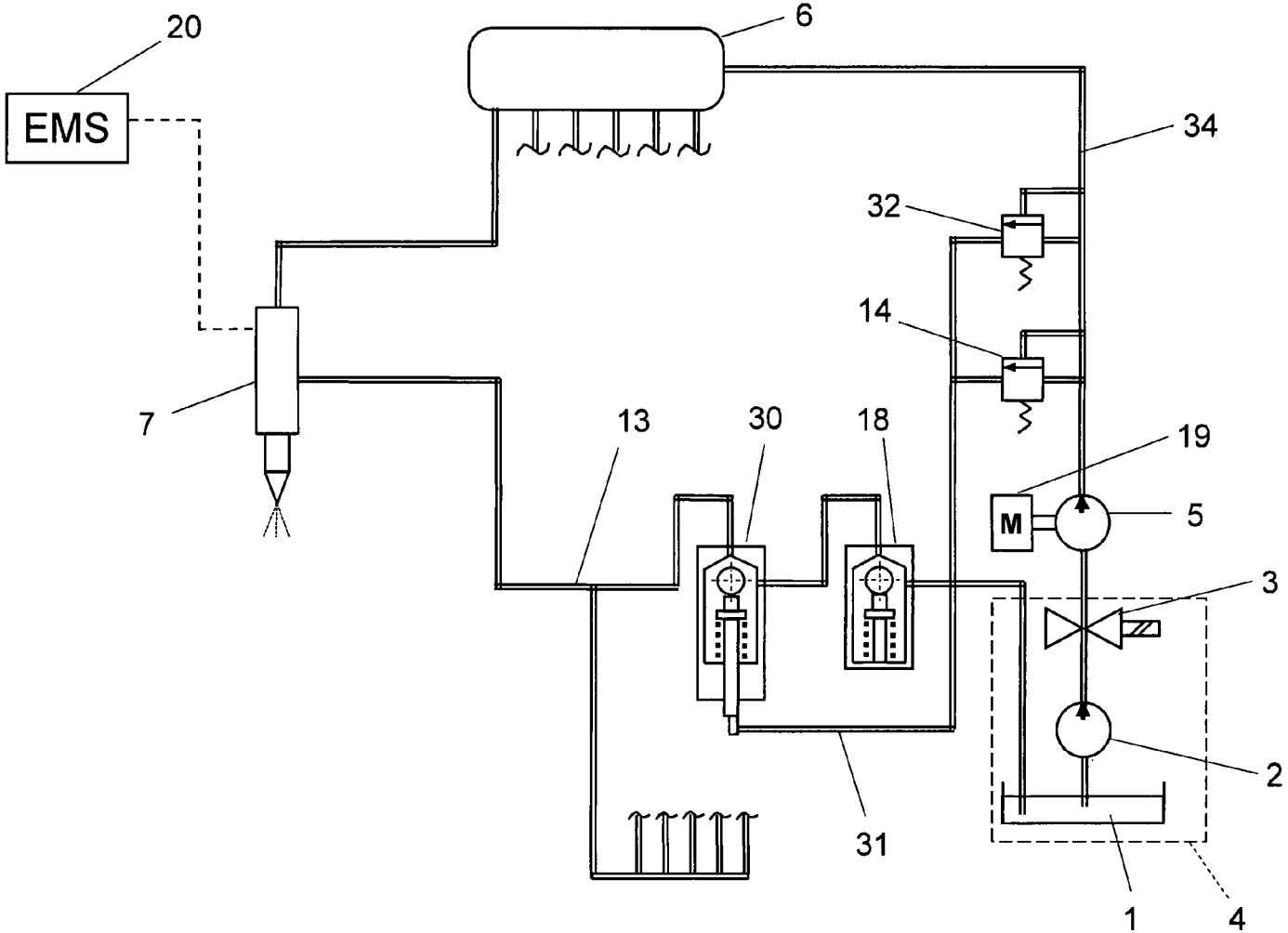
FIG. 2 shows a modified fuel system of the first embodiment of the invention.

A modification of the first embodiment is disclosed in FIG. 2, which discloses a fuel system essentially identical to the fuel system described in conjunction to FIG. 1, but further including an additional safety relief valve 32, which is arranged downstream of said high-pressure fuel pump 5 and upstream of said at least one fuel injector 7. A threshold level that triggers opening of the high-pressure fuel relief valve 14 is set lower than the threshold level that triggers opening of the additional safety relief valve 32. For example, the threshold level that triggers opening of the high-pressure fuel relief valve 14 is set to 420 bar, and the threshold level that triggers opening of the additional safety relief valve 32 is set to 430 bar. As mentioned above, this solution provides advantages in terms of safety aspects of the fuel system due to relief valve redundancy. Moreover, the additional safety relief valve 32 may be either mechanically operated, i.e. spring loaded, or electronically controlled, such that the threshold for triggering opening thereof may vary depending on the operating mode.

Figure 3:
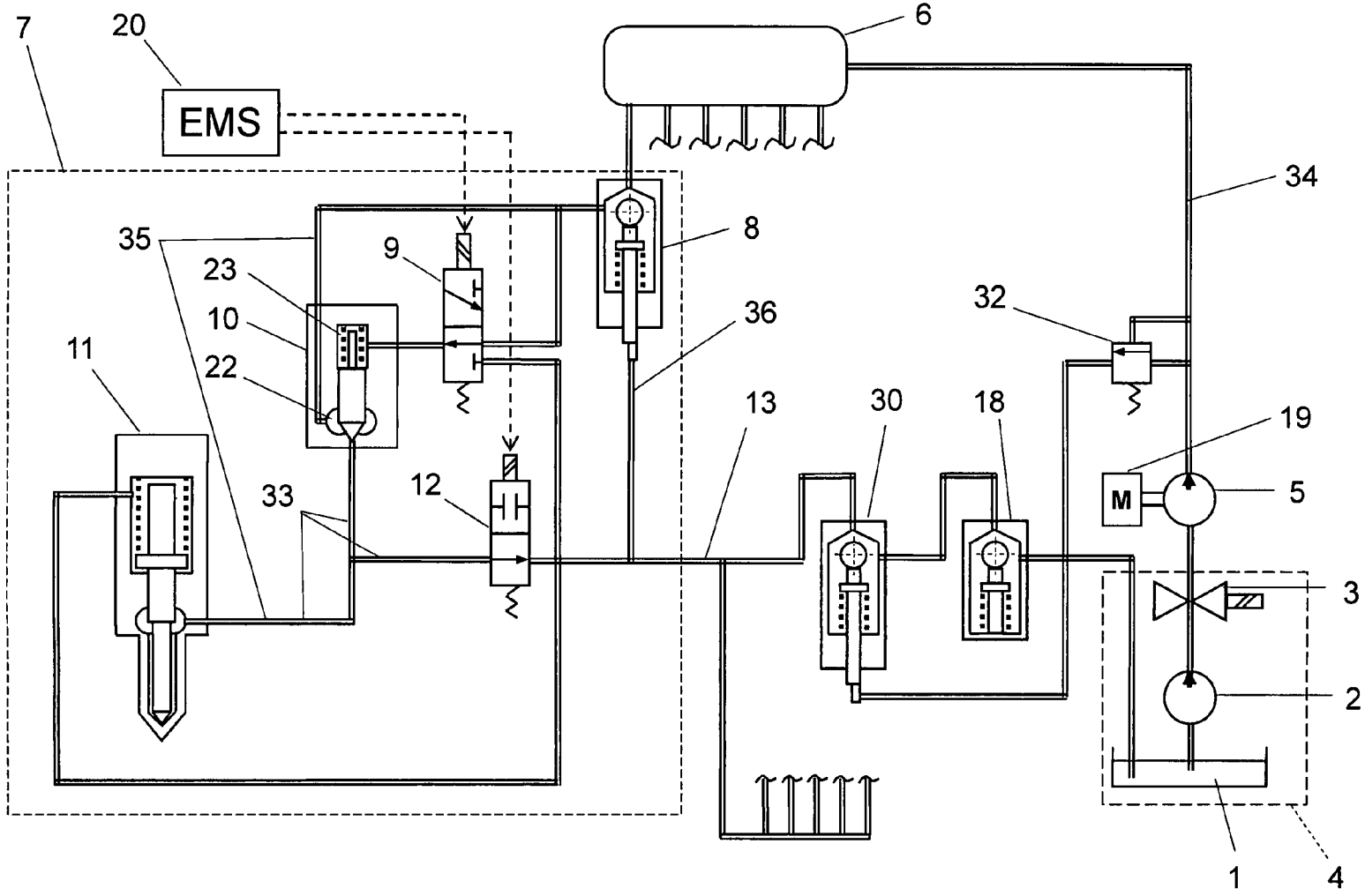
FIG. 3 shows a fuel system according to a second embodiment of the invention.

An alternative solution to the problem of fuel boiling according to a second embodiment of the invention is disclosed in FIG. 3. Many aspects of the fuel system of FIG. 3 are identical to the fuel system described in conjunction with FIG. 1, and reference is made to previous disclosure for said parts. In FIG. 3, a conventional safety relief valve 32 is provided. According to the second embodiment of the invention, a special fuel injector control is used for increasing the internal leakage within the fuel injector. The leaked fuel is then returned to the low pressure system 4 via a return line 13. The internal leakage within the fuel injector is generated by intelligent control of the valves within the fuel injector 7, as will be described more in details below.

The fuel injector 7 comprises an additional pressure isolating valve 8 arranged downstream of the common rail 6. The purpose and function of the additional pressure isolating valve 8 is essentially the same as the pressure isolating valve 30 arranged in the return line 13, i.e. to prevent leakage of fuel from the common rail 6 into the fuel injector 7, and further into the combustion chamber. Similar to the pressure isolating valve 30, the additional pressure isolating valve 8 is designed such that, once the valve is open, the area of the valve 8 that is exposed to the upstream pressure of the fuel is sufficiently big to hold the valve 8 open against the force of the valve's return spring and the backpressure acting on the valve when the upstream pressure is anywhere around a normal common rail pressure characteristic to a running engine. In case of engine being stopped and the common rail pressure falling below a predetermined level, the additional pressure isolating valve 8 closes and the area of the valve exposed to the pressure upstream, of the valve 8 becomes relatively small, such that a pressure above the feed pressure level is required to reopen the additional pressure isolating valve. Fuel leaking past a valve stem of the additional pressure isolating valve 8 is returned to the low pressure side 4 via an additional return line 36.

The fuel injector 7 further comprises an inlet valve 10 positioned between the common rail 6 and a nozzle 11. The inlet valve 10 controls fuel inlet to the fuel injector 7 via a fuel supply line 35 connecting said nozzle 11 with said common rail 6. The inlet valve 10 may be formed by an electrically actuated inlet valve that is directly controlled by the engine management system 20, but the inlet valve is preferably hydraulically operated by an electrically operated pilot valve 9 that controls the inlet valve 10. The fuel injector 7 further comprises an electrically operated normally open spill valve 12 positioned between the outlet of the inlet valve 10 and the return line 13. The spill valve 12 is herein disclosed as electrically actuated valve directly controlled by the engine management system 20, but other configurations are possible, such as hydraulically operated valve, or the like. The nozzle 11 has a needle that is biased by a return spring towards closing the nozzle 11. The return spring is installed in a spring chamber which, if pressurised, will assist the spring in biasing the needle towards nozzle closing. The outlet of the spill valve 12 is connected to the return line 13. The inlet valve 10 comprises an outlet chamber 22 and a control chamber 23, which is connected by the pilot valve 9 to either the common rail 6 via the additional pressure isolating valve 8, or the return line 13, depending on commands from the engine management system 20 that controls the pilot valve 9 and spill valve 12.

Referring to FIG. 3, the fuel injection system works as follows: Between individual consecutive injections and with the engine running, the high-pressure pump continuously supplies high pressure fuel to the common rail 6. The additional pressure isolating valve 8 is open; pressure upstream of nozzle 11 equals pressure in the return line 13 as set by the backpressure regulator 18. The pilot valve 9 and spill valve 12 are not activated by the engine management system 20. The pilot valve 9 is in its de-activated position, and connects the common rail 6 via the open additional pressure isolating valve 8 to the control chamber 23 of the inlet valve 10. The pressure from the common rail 6, combined with the force of the resilient means within the inlet valve 10, holds the inlet valve 10 in its closed position. An internal injector volume 33 is connected to the low pressure system 4 via the spill valve 12 in an open state, which internal injector volume 33 is defined essentially by the fuel line between the inlet valve 10 and the nozzle 11, and the fuel line between the inlet valve 10 and the spill valve 12. The nozzle 11 is closed by a needle return spring.

To begin an injection, the engine management system 20 applies control currents to the spill valve 12 closing it, and to the pilot valve 9, which disconnects the control chamber 23 of the inlet valve 10 from the common rail 6. The pressure in the control chamber 23 falls allowing the common rail pressure, acting on the inlet valve 10 from the outlet chamber 22, to open the inlet valve 10 against the force of the resilient means and the falling pressure in its control chamber 23. The initial opening of inlet valve 10 admits fuel from the pressurised common rail 6 into the nozzle 11 and raises the pressure there above the nozzle opening pressure that is defined by the force of the nozzle return spring. The needle opens the nozzle 11 and fuel injection begins. The flow through the nozzle 11 out into the combustion chamber of the engine generates a pressure drop across the inlet valve 10 and thus a positive difference between the pressure in the outlet chamber 22 and pressure in the control chamber 23, which fully opens inlet valve 10 and keeps it open as long as the pilot valve 9 is energised.

To terminate the injection, the engine management system 20 de-activates the pilot valve 9, which then disconnects the control chamber 23 from the downstream of inlet valve 10 and connects it back to the common rail 6. The pressure in the control chamber 23 rises and, together with the resilient means of the inlet valve 10, forces the inlet valve 10 down towards the closed position. During the closing period of the inlet valve 10 and corresponding reduction of its flow area, the fuel continues to be injected from the open nozzle 11 and the pressure in the nozzle 11 falls until the return spring thereof moves the needle down and closes the nozzle 11. Then the engine management system 20 de-activates and opens the spill valve 12 to relieve the nozzle 11 of the relatively high residual pressure which can otherwise leak past the closed nozzle 11 into the engine. The pressure in the nozzle 11 is brought down to the level set by the backpressure regulator 18, and the system is returned to its initial position as depicted by FIG. 3.

The alternative solution to the problem of fuel boiling according to a second embodiment of the invention is based on intelligent control of the pilot valve 9, inlet valve 10 and spill valve 12, such that a high level of internal fuel leakage within the fuel injector 7 is accomplished, thereby providing a recirculating cooling fuel flow through at least the high-pressure fuel pump, which flow assists in avoiding fuel boiling.

The increased internal leakage within the fuel injector is accomplished by an increased level of valve control leakage. The valve control leakage within the fuel injector 7 is increased by allowing inlet of fuel from the common rail 6 to the internal injector volume 33 of the fuel injector 7, while simultaneously and/or subsequently allowing discharge of fuel from the internal injector volume 33 to the return line 13, wherein the inlet of fuel into the fuel injector 7 and discharge of fuel from the fuel injector 7 is controlled by the engine management system 20 such that no fuel is injected into said combustion chamber by the nozzle 11.

More in detail, prior to opening the inlet valve 10, the fuel pressure in the internal injector volume is controlled essentially by the backpressure regulator 18, such that it is substantially lower than the pressure of the common rail 6, because the spill valve 12 is open allowing any residual high pressure fuel in the internal injector volume 33 to return to the low pressure system 4 via return line 13. Upon determining a need for recirculating cooling fuel flow, the engine management system 20, in view of increasing the internal injector leakage, arranges opening of the inlet valve 10 allowing high pressure fuel to enter the internal injector volume 33, while keeping the spill valve 12 open. The pressure within the internal injector volume 33 quickly increases despite the open spill valve 12 due to the limited flow capacity of the spill valve 12. Before the fuel pressure within said internal injector volume 33 is allowed to exceed a threshold level that triggers opening of the nozzle 11, the inlet valve 10 is closed, and the high pressure fuel with the internal injector volume is allowed to return in the return line 13 via spill valve 12.

This procedure may be performed once or repeatedly in a series of inlet/outlet sequences, controlled by means of a series of short duration control pulses from said engine management system 20.

The temporarily increased internal fuel leakage within the fuel injector 7 may be realised either during engine non-injecting operating mode, such as coasting or engine braking, or during engine injecting operation mode by scheduling said inlet and discharge of fuel between time periods of normal inlet and discharge of fuel associated with said engine injecting operation mode. Alternatively, the spill valve 2 may be configured to be constantly open during a certain time period while still injecting fuel by the nozzle 11. Thereby, normal fuel injection may be provided substantially simultaneously with increased internal injector leakage.

The degree of integration of the additional pressure isolating valve 8, pilot valve 9, inlet valve 10 and spill valve 12 may of course vary. A high degree of valve integration in preferred, but some or all of said valves 8-10, 12 may alternatively be arranged externally of the fuel injector 7 if this configuration is deemed advantageous.

The engine management system (EMS) determines the risk of fuel boiling within said high-pressure fuel pump based on one or more technical parameters, such as fuel temperature, fuel properties, fuel pressure, engine operating mode, engine temperature, engine rpm, fuel consumption flow, fuel control flow, engine brake controller engagement, or the like. Depending on the type and complexity of the used risk determination algorithm, the risk may either be of the Boolean type, i.e. there is a risk or there is no risk, or a level of risk may be determined, i.e. low level, middle level, high level, etc. The engine management system is then configured to initiate and sustain a cooling fuel flow when there is a risk, or when the level of risk is above a certain predetermined value.

Reference signs mentioned in the claims should not be seen as limiting the extent of the matter protected by the claims, and their sole function is to make claims easier to understand.

As will be realised, the invention is capable of being modified in various obvious respects, all without departing from the scope of the appended claims. Accordingly, the drawings and the description thereto are to be regarded as illustrative in nature, and not restrictive.

The invention claimed is:

1. Fuel system for supplying pressurised low viscosity fuel to an internal combustion engine, the fuel system comprising a low pressure fuel system, a high-pressure fuel pump, a common rail, at least one fuel injector, and an engine management system, the high-pressure fuel pump is arranged to supply pressurised fuel to the common rail, and the common rail is arranged to supply high-pressure fuel to the at least one fuel injector, which is configured to inject high-pressure fuel into a combustion chamber of the combustion engine, wherein the engine management system is arranged to initiate a recirculating cooling fuel flow through at least the high-pressure fuel pump for avoiding fuel boiling by means of either increasing the target pressure of the fuel within the common rail above a threshold level, which triggers opening a high-pressure fuel relief valve that is arranged, downstream of the high-pressure fuel pump, such that at least part of the fuel supplied by the high-pressure fuel pump is returned to the low pressure fuel system via the high-pressure fuel relief valve, or providing increased internal fuel leakage within the at least one fuel injector, such that at least part of the fuel supplied by the high-pressure fuel pump is returned to the low pressure fuel system by a return line.

2. Fuel system according to claim 1, wherein the engine management system is arranged to, upon determining a risk of fuel boiling within the high-pressure fuel pump, initiate the recirculating cooling fuel flow through the high-pressure fuel pump.

3. Fuel system according to claim 1, wherein the engine management system is configured to determine that there is a risk of fuel boiling within the high-pressure fuel pump when the engine is operated in a fuel non-injection mode.

4. Fuel system according to claim 1, wherein the engine management system is configured to determine the risk of fuel boiling within the high-pressure fuel pump based on at least one of the following parameters: engine operation mode, duration of the engine operation mode, fuel temperature adjacent and/or within the high-pressure fuel pump, fuel pressure adjacent and/or within the high-pressure fuel pump, fuel boiling point.

5. Fuel system according to claim 1, wherein the high-pressure fuel relief valve is a mechanical relief valve, which preferably is arranged along a fuel supply line between the high-pressure fuel pump and the common rail, or connected to the common rail.

6. Fuel system according to claim 1, wherein the high pressure fuel relief valve also functions as a safety pressure limiting relief valve of the fuel system for preventing damages to any of the common rail, the at least one fuel injector, or the high-pressure fuel pump due to excessive fuel pressure.

7. Fuel system according to claim 1, wherein the high-pressure fuel relief valve is the single relief valve downstream of the high-pressure fuel pump and upstream of the at least one fuel injector.

8. Fuel system according to claim 1, wherein the fuel system further comprises an additional safety relief valve (32) arranged downstream of the high-pressure fuel pump and upstream of the at least one fuel injector, wherein the threshold level that triggers opening the high-pressure fuel relief valve is lower than the threshold level that triggers opening of the additional safety relief valve (32).

9. Fuel system according to claim 1, wherein the temporarily increased internal fuel leakage within the at least one fuel injector is provided by increasing valve control leakage within the at least one fuel injector.

10. Fuel system according to claim 9, wherein the valve control leakage within the at least one fuel injector is increased by allowing inlet of fuel from the common rail to an internal injector volume (33) of the at least one fuel injector, while simultaneously and/or subsequently allowing discharge of fuel from the internal injector volume (33) to the return line, wherein the inlet and discharge of fuel is directly or indirectly controlled by the engine management system such that no fuel is injected into the combustion chamber (11).

11. Fuel system according to claim 10, wherein the at least one fuel injector comprises: a spring-loaded nozzle (11) for injecting high-pressure fuel into the combustion chamber; an inlet valve (10) arranged on a fuel supply line (35) connecting the nozzle (11) with the common rail, which inlet valve (10) is directly or indirectly controlled by the engine management system; and a spill valve (12) arranged on a fuel return line connecting the low pressure fuel system with the fuel supply line (35) between the inlet valve (10) and the nozzle (11), which fuel spill valve (12) is directly or indirectly controlled by the engine management system; wherein the inlet of fuel is controlled by the inlet valve (10), and the discharge of fuel is controlled by the spill valve (12), and wherein during the time of temporarily increased internal fuel leakage within the at least one fuel injector the inlet valve (10) and spill valve (12) are controlled such that the fuel pressure within the internal injector volume (33) is not exceeding a threshold level that triggers opening of the nozzle (11), thereby preventing fuel from being injected into the combustion chamber.

12. Fuel system according to claim 10, wherein the temporarily increased internal fuel leakage within the at least one fuel injector is provided by means of a series of short duration control pulses from the engine management system for providing repeated short duration inlet of fuel into the internal injector volume 33) and discharge of fuel from the volume (33).

13. Fuel system according to claim 10, wherein the temporarily increased internal fuel leakage within the at least one fuel injector is configured to be realised also during engine injecting operation mode by scheduling the inlet and discharge of fuel between time periods of normal inlet and discharge of fuel associated with the engine injecting operation mode.

14. Method for providing a recirculating cooling fuel flow through at least a high-pressure fuel pump, wherein the high pressure fuel pump is part of a fuel system that is configured to supply pressurised low viscosity fuel, in particular dimethyl ether (DME) or a blend thereof, to an internal combustion engine, in particular a compression ignition engine, the fuel system comprising a low pressure fuel system, a high-pressure fuel pump, a common rail, at least one fuel injector, and an engine management system, wherein the high-pressure fuel pump is arranged to supply pressurised fuel to the common rail, and wherein the common rail is arranged to supply high-pressure fuel to the at least one fuel injector, which is configured to inject high-pressure fuel into a combustion chamber of the combustion engine, the method comprising:

initiating a recirculating cooling fuel flow through at least the high-pressure fuel pump for avoiding fuel boiling by means of either increasing the target pressure of the fuel within the common rail above a threshold level that triggers opening a high-pressure fuel relief valve that is arranged downstream of the high-pressure fuel pump, such that at least part of the fuel supplied by the high-pressure fuel pump is returned to the low pressure fuel system via the high-pressure fuel relief valve, or providing increased internal fuel leakage within the at least one fuel injector, such that at least part of the fuel supplied by the high-pressure fuel pump is returned to the low pressure fuel system by a return line.

* * * * *